US011478811B2

(12) United States Patent
Kuniharu et al.

(10) Patent No.: US 11,478,811 B2
(45) Date of Patent: Oct. 25, 2022

(54) PAINT REFILLING DEVICE FOR CARTRIDGE

(71) Applicant: ABB Schweiz AG, Baden (CH)

(72) Inventors: Yamauchi Kuniharu, Tokyo (JP); Sonoda Tetsuya, Shimada (JP)

(73) Assignee: ABB SCHWEIZ AG, Baden (CH)

( * ) Notice: Subject to any disclaimer, the term of this patent is extended or adjusted under 35 U.S.C. 154(b) by 369 days.

(21) Appl. No.: 16/670,129

(22) Filed: Oct. 31, 2019

(65) Prior Publication Data

US 2020/0188948 A1 Jun. 18, 2020

(30) Foreign Application Priority Data

Dec. 13, 2018 (JP) ..... JP2018-233393

(51) Int. Cl.
*B05B 15/55* (2018.01)
*B05B 9/03* (2006.01)

(52) U.S. Cl.
CPC ..... *B05B 15/55* (2018.02); *B05B 9/03* (2013.01)

(58) Field of Classification Search
CPC ..... B05B 15/55; B05B 9/03
See application file for complete search history.

(56) References Cited

U.S. PATENT DOCUMENTS

2002/0015148 A1 2/2002 Tomomatsu
2010/0230511 A1* 9/2010 Umezawa ..... B25J 15/0491 239/303
2010/0243101 A1* 9/2010 Matsumoto ..... B05B 5/1675 141/90

FOREIGN PATENT DOCUMENTS

CN 101128265 A 2/2003
CN 101541436 A 9/2009
(Continued)

OTHER PUBLICATIONS

European Patent Office, Extended European Search Report issued in corresponding European application No. 19206505.0, dated Apr. 23, 2020, 7 pp.

(Continued)

*Primary Examiner* — Jason K Niesz
(74) *Attorney, Agent, or Firm* — Greenberg Traurig, LLP

(57) ABSTRACT

The present application relates to a cartridge paint refilling device. More specifically the subject matter of the application relates to cleaning the paint adhered to the feed tube of the cartridge and prevent reduction of the painting quality and undesirable rotation caused by the paint residue. An annular flow path extending from a base end side towards a front end side in the insertion direction is disposed between the feed tube of the cartridge and the feed tube insertion hole of the cartridge supporting member. The cartridge supporting member is provided with a feed tube cleaning pipeline whose upstream side is connected with the circulation pipeline disposed at the cartridge supporting member and whose downstream side becomes a cleaning fluid discharge port and pens at the base end side of the annular flow path; and a pipeline witching valve which blocks communication between the circulation pipeline and the feed tube cleaning pipeline when the paint and the cleaning fluid are supplied to the paint chamber of the cartridge, and enables communication between the circulation pipeline and the feed tube cleaning pipeline when the cleaning fluid is supplied to the annular flow path.

7 Claims, 12 Drawing Sheets

(56) References Cited

FOREIGN PATENT DOCUMENTS

| | | | |
|---|---|---|---|
| CN | 201579155 | U | 9/2010 |
| CN | 103118795 | A | 5/2013 |
| CN | 106457278 | A | 2/2017 |
| EP | 1277520 | A1 | 1/2003 |
| EP | 2095879 | A1 | 9/2009 |
| EP | 2636454 | A1 | 9/2013 |
| JP | H0563656 | U | 8/1993 |
| JP | H07251103 | A | 10/1995 |
| JP | H11262726 | A | 9/1999 |
| JP | 2002011396 | A | 1/2002 |
| JP | 2002079149 | A | 3/2002 |
| JP | 3276796 | B2 | 4/2002 |
| KR | 20020026182 | A | 4/2002 |
| WO | 2008065794 | A1 | 3/2010 |

OTHER PUBLICATIONS

Chinese Patent Office, First Office Action issued in corresponding Application No. 2019110464626, dated Dec. 18, 2020, 10 pp.
Japanese Patent Office, Office Action issued in corresponding Application No. 2018-233393, dated Nov. 9, 2020, 4 pp.

* cited by examiner

PAINT REFILLING DEVICE FOR CARTRIDGE

FIELD

The present disclosure relates to a paint refilling device for a cartridge suitable for use, for example, in refilling paint into a cartridge which is replaced from or mounted to a painting device.

BACKGROUND

In general, a painting device for use in painting work pieces such as vehicle bodies is required to reduce the amount of wasted paint which has to be discharged at the time of a color change, and to cope with a large number of paint colors, and to prevent leakage of high voltage applied to the paint, etc. As a painting device which copes with these requirements, a cartridge-type painting device that replaces and mounts a cartridge refilled with paint to a coating machine which sprays the paint is known.

The cartridge of the cartridge-type painting device is formed as including a tank refilled with paint, a partition that is movably provided in the tank to divide the interior of the tank into a paint chamber and an extrusion liquid chamber, and a feed tube whose base end side is mounted to the tank and front end side extends axially from the tank.

The cartridge enables changing of colors and use of paints of multiple colors. When the paint of a next color is refilled, the cartridge is mounted at the paint refilling device for a cartridge as a part of the paint refilling device for a cartridge. Furthermore, in the paint refilling device for a cartridge, the residual paint of the previous color in the tank and the feed tube can be cleaned during color changing.

The paint refilling device for a cartridge for refilling the paint into the cartridge comprises: a cartridge supporting member provided with a feed tube insertion hole which extends axially and allows the feed tube to be inserted therethrough, and the cartridge supporting member having a tank supporting portion for supporting the tank of the cartridge at the base end side of the feed tube insertion hole in the insertion direction when the paint is refilled; a circulation pipeline which is disposed on the cartridge supporting member in a manner of being connected to the paint chamber of the cartridge to circulate the paint and a cleaning fluid; a color change valve device which is disposed to be connected to the circulation pipeline to supply the paint selected from the paints of multiple colors to the paint chamber of the cartridge when the paint is refilled, and to supply the cleaning fluid to the paint chamber and a paint supply passageway of the feed tube when residual paint is cleaned.

During a refilling operation of refilling the cartridge with the paint through the paint refilling device for a cartridge, after the painting operation is finished, a painting robot transports a painting machine on which the cartridge is mounted to the paint refilling device for a cartridge. When the painting machine and the cartridge are arranged at the cartridge attachment/detachment position, the cartridge is gripped by the cartridge transporting device and pulled out of the painting machine. The used cartridge is assembled to the cartridge supporting member by inserting the feed tube into the feed tube insertion hole and mounting the tank to the tank supporting portion.

When the cartridge is assembled to the cartridge supporting member, after discharging the residual paint in the tank, the paint refilling device for a cartridge then supplies the cleaning fluid from the color change valve device to clean the paint of the previous color adhered to the paint chamber of the tank and the paint supply passageway of the feed tube. Then, the paint of next color is supplied from the color change valve device, and refilled to the paint chamber (e.g., referring to Patent Literature 1 and Patent Literature 2).

THE PRIOR ART DOCUMENTS

Patent Literatures

Patent Literature 1: gazette of Japanese Laid-open No. H 11-262726

Patent Literature 2: gazette of Japanese Laid-open No. 2002-11396.

SUMMARY

When the painting machine and the cartridge are arranged at the attachment/detachment position of the cartridge by the painting robot, sometimes certain errors (deviations) might occur between a stop position of the cartridge and a gripping position where the cartridge transporting device grips. On the other hand, the painting machine is reduced in size by reducing for example a gap between an inner circumferential surface of a rotary shaft into which the feed tube of the cartridge is inserted and an outer circumferential surface of the feed tube.

If an error occurs in the stop position of the cartridge, the inner circumferential surface of the rotary shaft would contact the outer circumferential surface of the feed tube when the cartridge is pulled out of the painting machine with the cartridge transporting device. At this time, the paint adhering to the front end side of the feed tube adheres to the inner circumferential surface of the rotary shaft. Therefore, if the operation of pulling the cartridge out of the painting machine is repeated, the paint adheres and extends to the whole inner circumferential surface of the rotary shaft and the whole outer circumferential surface of the feed tube. In addition, there is a concern that the extended paint reaches an air bearing and an air turbine of an air motor.

Furthermore, the paint accumulates on the rotary shaft and the feed tube and so on over time, and the accumulated paint peels off and becomes paint residue shortly thereafter. The position where the paint residue is generated is a space between the rotary shaft and the feed tube, which is connected with a rotary atomizing head which sprays the paint. If the paint residue enters the rotary atomizing head, there will be a problem that the paint residue may be sprayed toward the object together with the paint, thereby causing reduction of the painting quality.

In addition, if the paint adheres to the air bearing or air turbine of the air motor, there exist concerns about defects such as poor rotation, so frequent cleaning operations need to be performed which causes reduction of the production performance. In addition, sometimes the paint adhering to the outer circumferential surface of the feed tube might fall off while the paint refilling device for a cartridge moves the cartridge towards the painting machine, resulting in a problem with pollution and damage to the device.

The present disclosure is proposed to address the above technical problems in the prior art and aims to provide a paint refilling device for a cartridge which can prevent, by cleaning the paint adhering to the feed tube of the cartridge, reduction of the painting quality and poor rotation due to the paint residue.

The paint refilling device for a cartridge of the present disclosure comprises: a cartridge configured as comprising a tank for storing the paint, a partition and a feed tube, the partition being movably disposed within the tank and dividing an interior of the tank into a paint chamber into which the paint is refilled and an extrusion liquid chamber for supplying or discharging extrusion liquid, a base end side of the feed tube being mounted to the tank and a front end side extending axially from the tank; a cartridge supporting member provided with a feed tube insertion hole extending axially and allowing the feed tube to be inserted therethrough, and a tank supporting portion for supporting the tank of the cartridge at a base end side in an insertion direction of the feed tube insertion hole; a circulation pipeline disposed on the cartridge supporting member in a manner of being connected to the paint chamber of the cartridge to circulate the paint and a cleaning fluid; and a paint supply device disposed to be connected to the circulation pipeline, to supply the paint to the paint chamber of the cartridge upon refilling the paint, and to supply the cleaning fluid to the paint chamber and a paint supply passageway within the feed tube upon cleaning of the residual paint, wherein an annular flow path, extending from a base end side towards a front end side in the insertion direction, is disposed between the feed tube of the cartridge and the feed tube insertion hole of the cartridge supporting member, the cartridge supporting member is provided with a feed tube cleaning pipeline and a pipeline switching valve, an upstream side of the feed tube cleaning pipeline is connected with the circulation pipeline, and a downstream side is formed as a cleaning fluid discharge ports which are opened at the base end side of the annular flow path; the pipeline switching valve blocks communication between the circulation pipeline and the feed tube cleaning pipeline when the paint and the cleaning fluid are supplied to the paint chamber of the cartridge, and enables communication between the circulation pipeline and the feed tube cleaning pipeline when the cleaning fluid is supplied to the annular flow path.

Effects of the Present Disclosure

According to the present disclosure, it is possible to clean the paint adhered to the feed tube of the cartridge and prevent reduction of the painting quality and undesirable rotation caused by the paint residue.

WHEREIN REFERENCE SIGNS ARE INTRODUCED AS FOLLOWS

Figure 1:
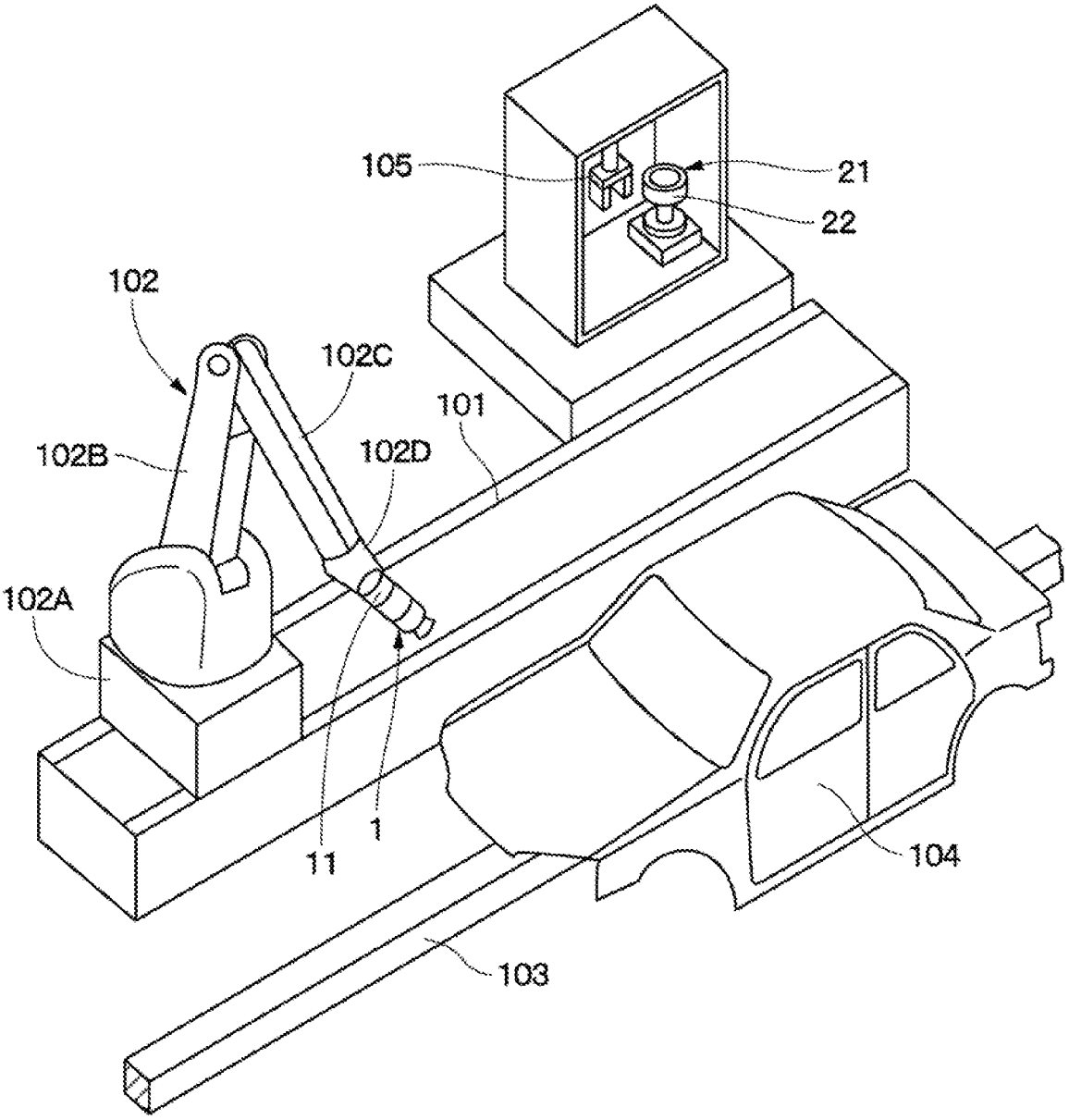
FIG. 1 is an overall configuration diagram simultaneously showing a paint refilling device for a cartridge and a painting robot, a rotary atomizing head type painting device, a vehicle body conveyance line, and the like according to a first embodiment of the present disclosure.

11 cartridge
12 tank
13 piston (partition)
14 Paint chamber
15 Extrusion liquid chamber
16 Feed tube
16A Paint supply path
17 Paint chamber open/close valve
21 paint refilling device for a cartridge
22 Cartridge supporting member
23 Feed tube insertion hole
24 Tank supporting portion
25 Circulation pipeline
26 annular flow path
29 Feed tube cleaning pipeline
29C discharge passageway
29C1 Cleaning fluid discharge port
30 pipeline switching valve
31 Sealing member
34 Color change valve device (paint supplying device)
51 Swirl flow forming member
O axial center of the feed tube insertion hole
A straight line
G deviating dimensions.

DETAILED DESCRIPTION

Hereinafter, a paint refilling device for a cartridge according to embodiments of the present disclosure will be described in detail with reference to the accompanying drawings. In the present detailed description, illustration is presented in a case where the paint refilling device for a cartridge refills the paint to a cartridge mounted to a rotary atomizing heat type painting device in a replaceable manner.

FIG. 1 to FIG. 11 show a paint refilling device for a cartridge and a painting line which needs to use the paint refilling device for a cartridge to refill the paint according to a first embodiment of the present disclosure.

First, FIG. 1 shows an overview of a painting line in which the paint refilling device for a cartridge 21 is arranged. A robot movement rail 101 is provided along a vehicle body conveyance line 103 which will be described later. The painting robot 102 is configured to include a base 102A that is movably provided on the robot movement rail 101, a vertical arm 102B that is rotatably and swingably provided on the base 102A, a horizontal arm 102C swingably provided at a front end of the vertical arm 102B, and a wrist 102D provided rotatably at a front end of the horizontal arm 102C. The vehicle body conveyance line 103 is equipped in a painting factory, and enables a vehicle body 104 as an object to be painted, to move along the robot movement rail 101.

The cartridge transporting device 105 is disposed nearby the painting robot 102. The cartridge transporting device 105 is composed of a multi-articulation (multi-axis) robot or a dedicated transporting device, and grips which transports the cartridge 11 between a housing 2 of the rotary atomizing head type painting device 1 and the cartridge supporting member 22 of the paint refilling device for a cartridge 21.

Here, upon completion of the painting operation, the painting robot 102 moves the rotary atomizing head type painting device 1 on which the used cartridge 11 is mounted to a gripping position where the cartridge transporting device 105 grips the cartridge. On the other hand, the cartridge transporting device 105 performs the following actions: gripping the used cartridge 11 which has been transported to the gripping position, drawing the cartridge out of the housing 2 (painting machine 4) and mounting the cartridge to the cartridge supporting member 22 of the paint refilling device for a cartridge 21.

Next, the rotary atomizing head type painting device 1 applied to the first embodiment of the present disclosure will be described.

Figure 2:
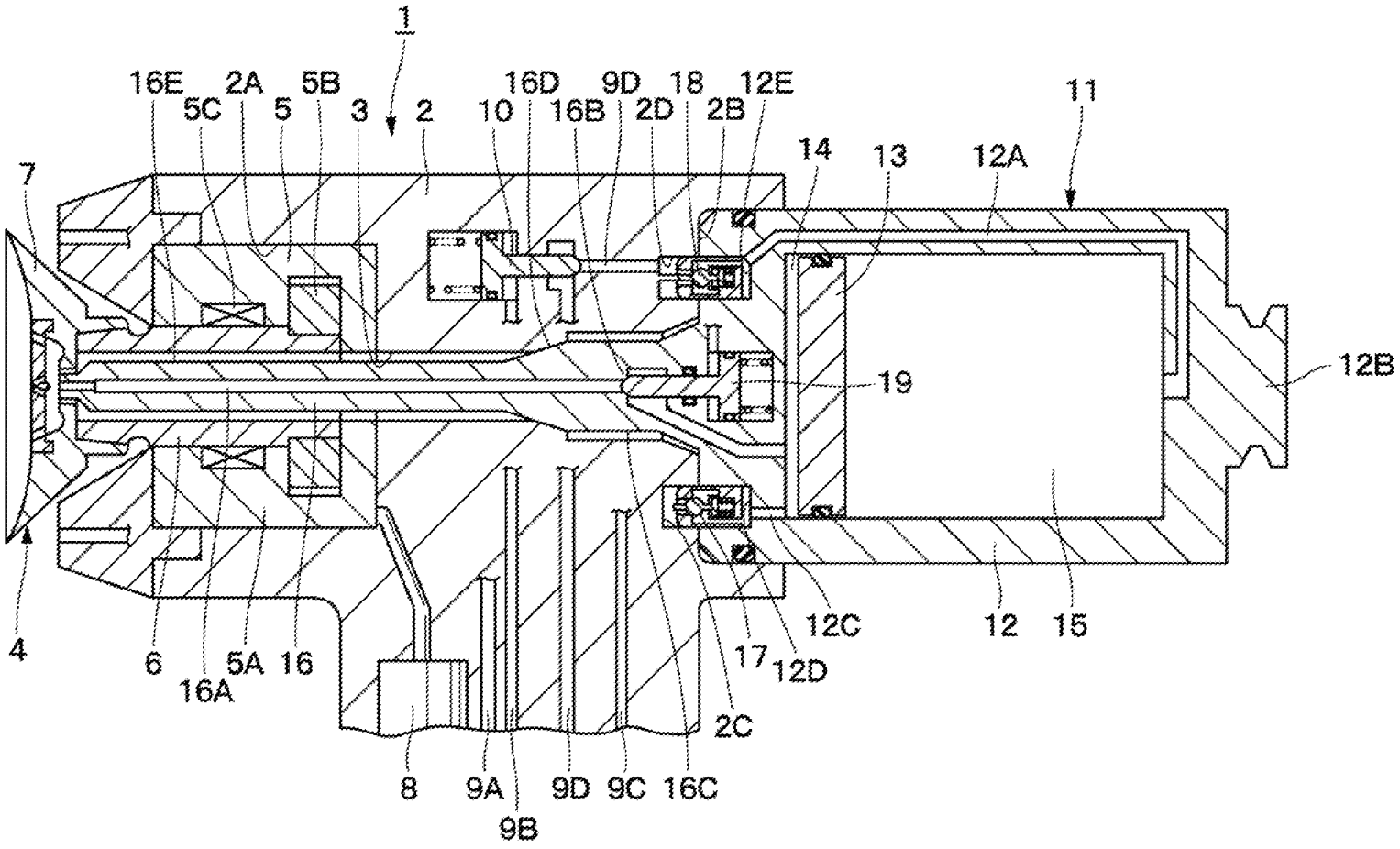
FIG. 2 is an enlarged longitudinal sectional view showing the rotary atomizing head type painting device in FIG. 1.

The rotary atomizing head type painting device 1 (hereinafter referred to as painting device 1) is provided on the wrist 102D of the painting robot 102. As shown in FIG. 2, the painting device 1 is configured to include the housing 2, the painting machine 4 and the cartridge 11 which will be described later.

The housing 2 of the painting device 1 is mounted at a front end of the wrist 102D of the painting robot 102. A painting machine mounting portion 2A in a bottomed cylindrical shape is formed on the front side of the housing 2, and a cartridge mounting portion 2B in a bottomed cylindrical shape is formed on the rear side of the housing 2. Furthermore, the bottom of the cartridge mounting portion 2B is provided with a fitting hole 2C into which a paint chamber open/close valve 17 of the cartridge 11 to be described later is fitted, and a valve connecting portion 2D connected to an extrusion liquid sealing valve 18. The fitting hole 2C and the valve connecting portion 2D also have a function of positioning the tank 12 in a circumferential direction in a state where the tank 12 of the cartridge 11 is mounted to the cartridge mounting portion 2B.

The insertion hole 3 is disposed at a central portion of the housing 2 in a manner of extending axially. The insertion hole 3 is used for inserting a feed tube 16 of the cartridge 11 described later. Furthermore, a front end side of the insertion hole 3 is formed axially in a way of running through the interior of a rotary shaft 6 provided in an air motor 5 described later.

The painting machine 4 is mounted at the painting machine mounting portion 2A of the housing 2. The painting machine 4 is configured to include an air motor 5 comprising a motor casing 5A, an air turbine 5B and an air bearing 5C; a rotary shaft 6 that is freely rotatably supported by the air bearing 5C in a state where the air turbine 5B is mounted on its base end; and a rotary atomizing head 7 that is mounted at a front end of the rotary shaft 6 and rotated by the air motor 5 such that the paint supplied through the feed tube 16 is centrifugally atomized and micronized, and sprayed to the object to be painted. The air motor 5 detects a rotation speed of the air turbine 5B for example by use of optical fibers (not shown), so that the rotation speed is controlled as an optimal rotation speed according to painting conditions.

A high voltage generator 8 is disposed on the housing 2. The high voltage generator 8 is composed of for example a cockcroft circuit, and boosts a voltage supplied from a power supply device (not shown) to −60 to −120 kV. Furthermore, an output side of the high voltage generator 8 is electrically connected to, for example, the air motor 5. In this way, the high voltage generator 8 rotates via the rotary shaft 6, and applies a high voltage to the atomizing head 7 so that the paint supplied to the rotary atomizing head 7 is directly charged.

A plurality of flow paths 9A, 9B, 9C, and 9D are provided on the housing 2 and connected to an air supply control device and an extrusion liquid supply device (both not shown). Among the plurality of flow paths 9A to 9D, the flow paths 9A, 9B and 9C shown as representative examples allow circulation of turbine air for controlling the air motor 5, bearing air, brake air, forming air for forming a spray pattern of the paint, and pressurized air enabling an extrusion liquid valve 10 and a trigger valve 19 to perform opening and closing operations, and are connected to a control air source (not shown).

In addition, the flow path 9D among the plurality of flow paths 9A to 9D allows circulation of an extrusion liquid for extruding the paint out of the cartridge 11. One end of the flow path 9D is connected to the extrusion liquid supply device (not shown), and the other end is opened at the bottom of the valve connecting portion 2D formed at the cartridge mounting portion 2B of the housing 2.

The extrusion liquid valve 10 is disposed on the housing 2. The extrusion liquid valve 10 normally blocks the flow path 9D so as to block the communication of the extrusion liquid to the extrusion liquid chamber 15 of the cartridge 11. In addition, when the extrusion liquid valve 10 is opened, the extrusion liquid valve 10 permits the circulation of the extrusion liquid to the extrusion liquid chamber 15 to supply and discharge the extrusion liquid.

Next, the configuration of the cartridge 11 used in the first embodiment of the present disclosure will be described.

Figure 3:
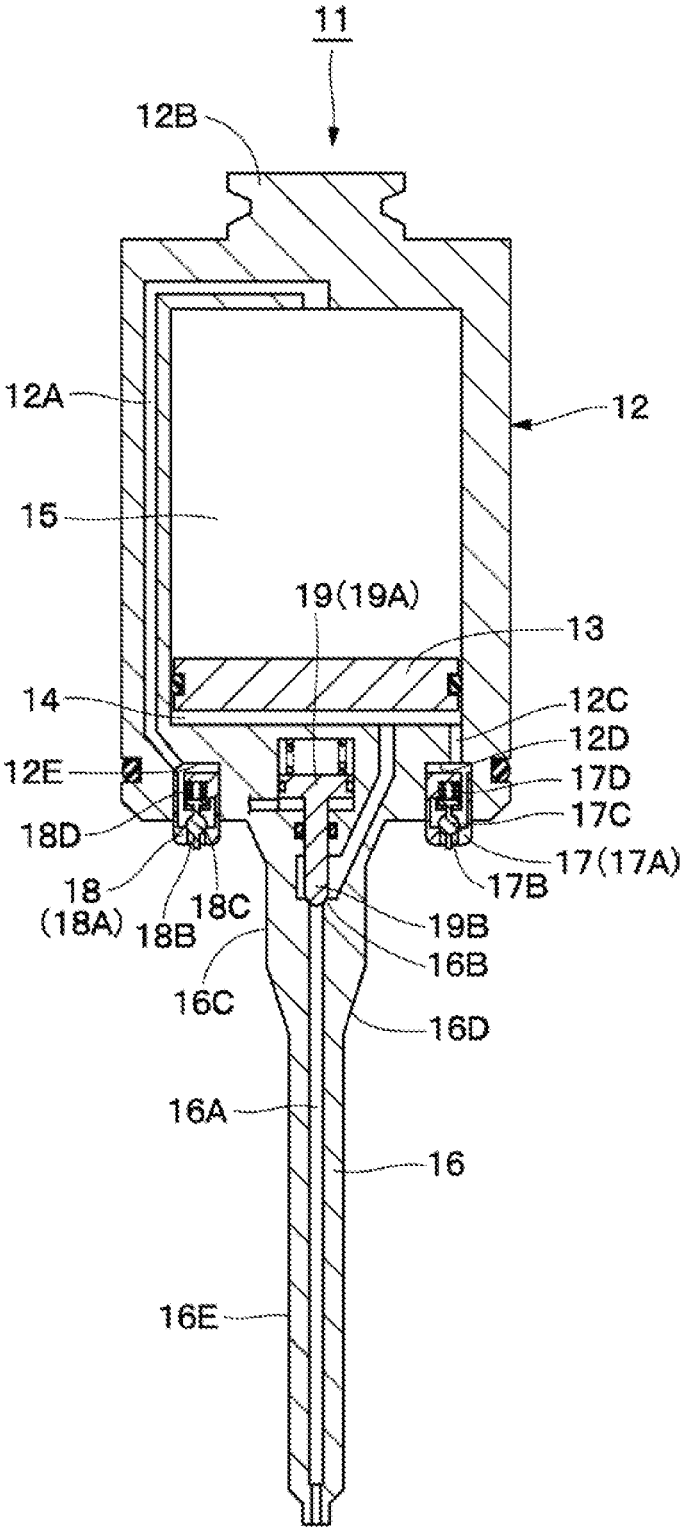
FIG. 3 is a longitudinal sectional view showing the cartridge in FIG. 2 as a single unit.

The cartridge 11 is detachably mounted to the cartridge attachment portion 2B of the housing 2, and on the other hand, is detachably mounted to the cartridge supporting member 22 of the paint refilling device for a cartridge 21 described later. Here, as shown in FIG. 3, the cartridge 11 includes a tank 12, a piston 13 and a feed tube 16 which will be described later.

The tank 12 is formed as a cylindrical container with both axial ends thereof closed. In addition, a circular piston 13 forming a partition is inserted into the tank 12 in a manner of being displaceable in the axial direction. The piston 13 divides the interior of the tank 12 into a paint chamber 14 in which paint is refilled located on the front side and a extrusion liquid chamber 15 located on the rear side for supplying and discharging the extrusion liquid.

Figure 8:
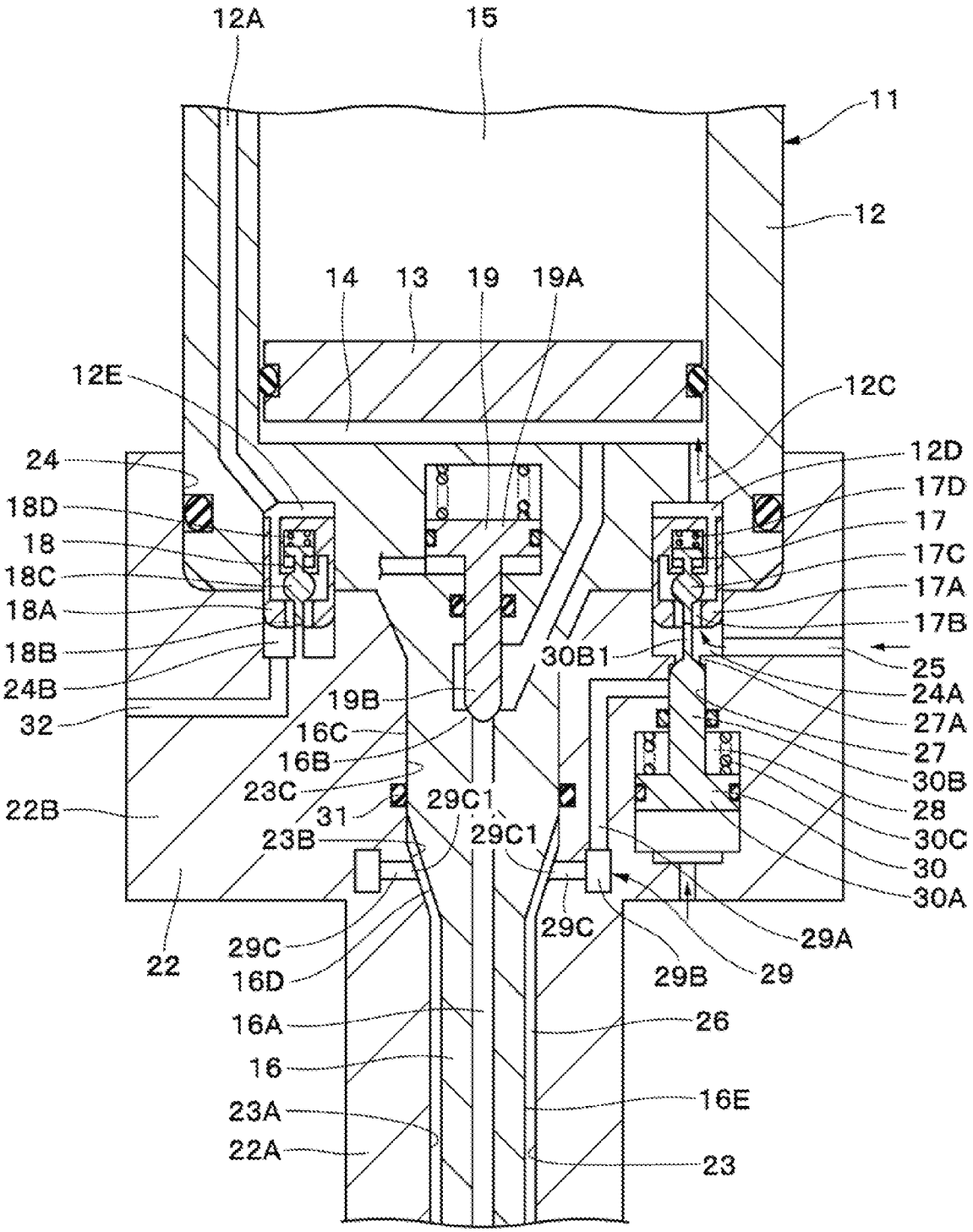
FIG. 8 is an enlarged longitudinal sectional view simultaneously showing a paint chamber open/close valve and a pipeline switching valve in a state of supplying a paint and a cleaning fluid to a paint chamber of the tank, and a portion of the cartridge supporting member and the cartridge.

An extrusion liquid flow path 12A is formed on the tank 12 by opening at a rear position of the extrusion liquid chamber 15. Further, a gripping protrusion 12B for gripping and transporting the cartridge 11 is provided at a rear end of the tank 12. On the other hand, a paint flow path 12C in communication with the paint chamber 14 is provided on the front side of the tank 12. Furthermore, on the front side of the tank 12 are provided a valve mounting hole 12D for mounting a paint chamber open/close valve 17 which will be described later and a valve mounting hole 12E for mounting an extrusion liquid sealing valve 18. Here, as shown in FIG. 8, when the cartridge 11 is mounted to the cartridge supporting member 22 which will be described later, the paint flow path 12C enables the circulation pipeline 25 on the side of the cartridge supporting member 22 to communicate with the paint chamber 14.

The feed tube 16 extending axially from a front central position of the tank 12 is provided. The front end side of the feed tube 16 extends within the insertion hole 3, and the front end portion is opened toward the rotary atomizing head 7. In addition, a paint supply passageway 16A in communication with the paint chamber 14 of the tank 12 is formed within the feed tube 16. Furthermore, in the feed tube 16 is provided a valve seat portion 16B at a position midway along the paint supply passageway 16A.

The feed tube 16 includes a large-diameter portion 16C that has a thick wall and a large diameter and is located at the side of the tank 12, namely the base end side; a funnel-shaped diameter-reduced portion 16D which is disposed in such a manner that the diameter of the front end side of the large-diameter portion 16C is gradually reduced; and a small-diameter portion 16E which has a thin wall and a small diameter and extends forward from the diameter-reduced portion 16D.

Figure 9:
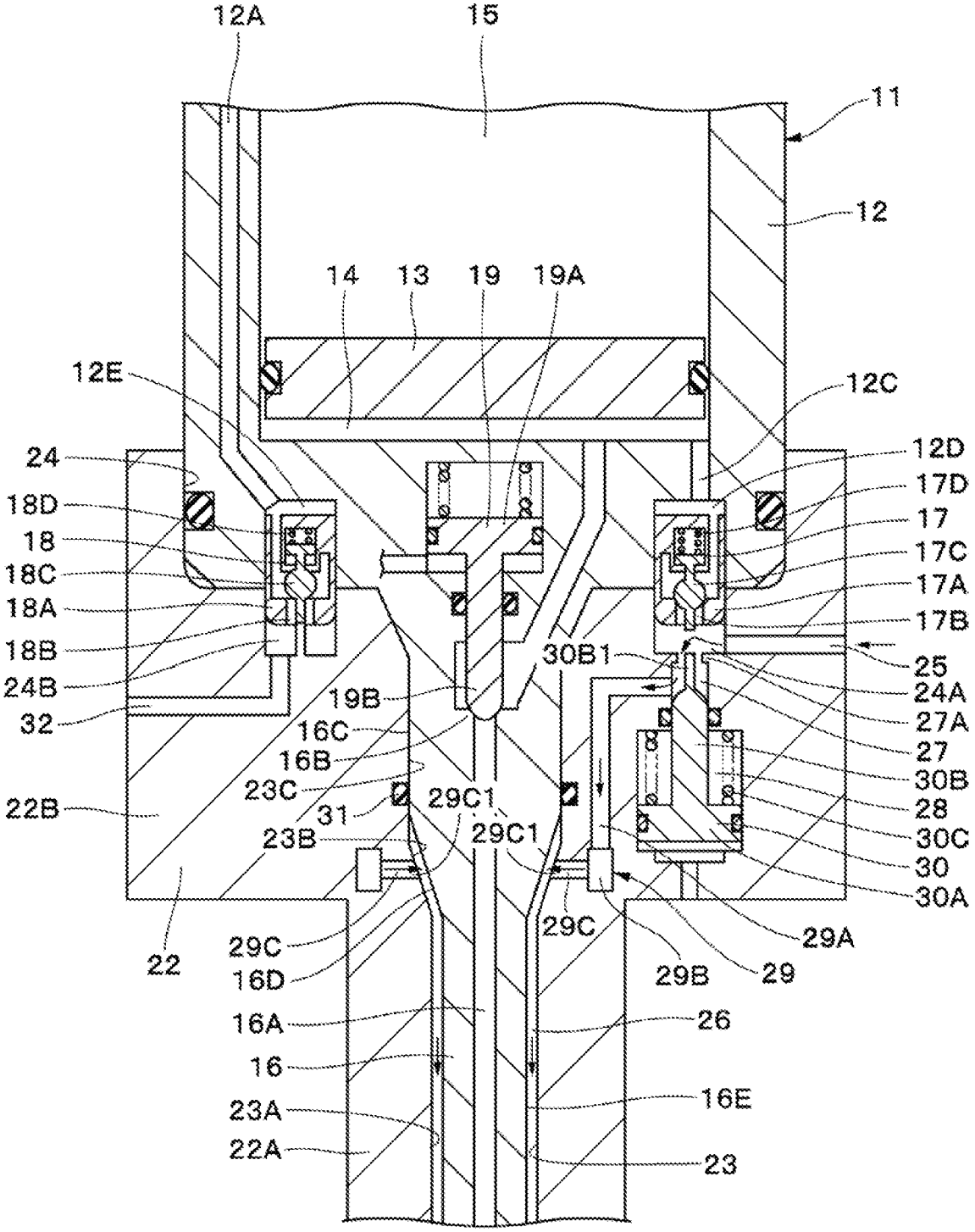
FIG. 9 is an enlarged longitudinal sectional view simultaneously showing a paint chamber open/close valve and a pipeline switching valve in a state of supplying a cleaning fluid to an annular flow path, and a portion of the cartridge supporting member and the cartridge.

The paint chamber open/close valve 17 is located at an open end of the paint flow path 12C of the tank 12 and provided in the valve mounting hole 12D. As shown in FIGS. 8 and 9, the paint chamber open/close valve 17 together with a pipeline switching valve 30 which will be described later constitute a two-position three-way switching valve in a state where the tank 12 is mounted to the tank supporting portion 24 of the cartridge supporting member 22. The paint chamber open/close valve 17 includes a valve casing 17A inserted into the valve mounting hole 12D in such a manner that a front end portion thereof protrudes out of the valve mounting hole 12D; a through hole 17B provided at a front end side of the valve casing 17A; a valve core 17C movably provided within the valve casing 17A to make the through hole 17B open and closed; and a valve spring 17D that presses the valve core 17C toward the front end side in the valve closing direction.

As shown in FIG. 9, the paint chamber open/close valve 17 blocks the through hole 17B with the valve core 17C in a state where the cartridge 11 is separated and mounted to the painting device and in a state where the tank 12 is mounted to the tank supporting portion 24 of the cartridge supporting member 22. On the other hand, as shown in FIG. 8, in the state where the tank 12 is mounted to the tank supporting portion 24 of the cartridge supporting member 22, when the valve core 17C is pushed by the pipeline switching valve 30 which will be described later, the through hole is opened to communicate the paint flow path 12C (the paint chamber 14) with the later-described circulation pipeline 25.

The extrusion liquid sealing valve 18 is located at the open end of the extrusion liquid flow path 12A of the tank 12 and provided in the valve mounting hole 12E. The extrusion liquid sealing valve 18 has a valve case 18A, a through hole 18B, a valve core 18C and a valve spring 18D in substantially the same manner as the aforesaid paint chamber open/close valve 17. In the state where the cartridge 11 is separated, the extrusion liquid sealing valve 18 blocks the through hole 18B with the valve core 18C and functions as a check valve. On the other hand, in the state where the tank 12 is mounted to the painting device 1 and the tank supporting portion 24 of the cartridge supporting member 22, the extrusion liquid sealing valve 18 opens the through hole 18B.

The trigger valve 19 is provided at a front position of the tank 12. The trigger valve 19 opens and closes the paint supply passageway 16A within the feed tube 16. The trigger valve 19 is a bidirectional two-position and normally-closed air-driven open/close valve, and comprises a piston 19A that is axially displaceable and a valve core 19B that extends from the piston 19A toward the paint supply passageway 16A and has a front end unseated/seated relative to a seat portion 16B.

Next, the paint refilling device for a cartridge 21 used in the first embodiment will be described.

Figure 4:
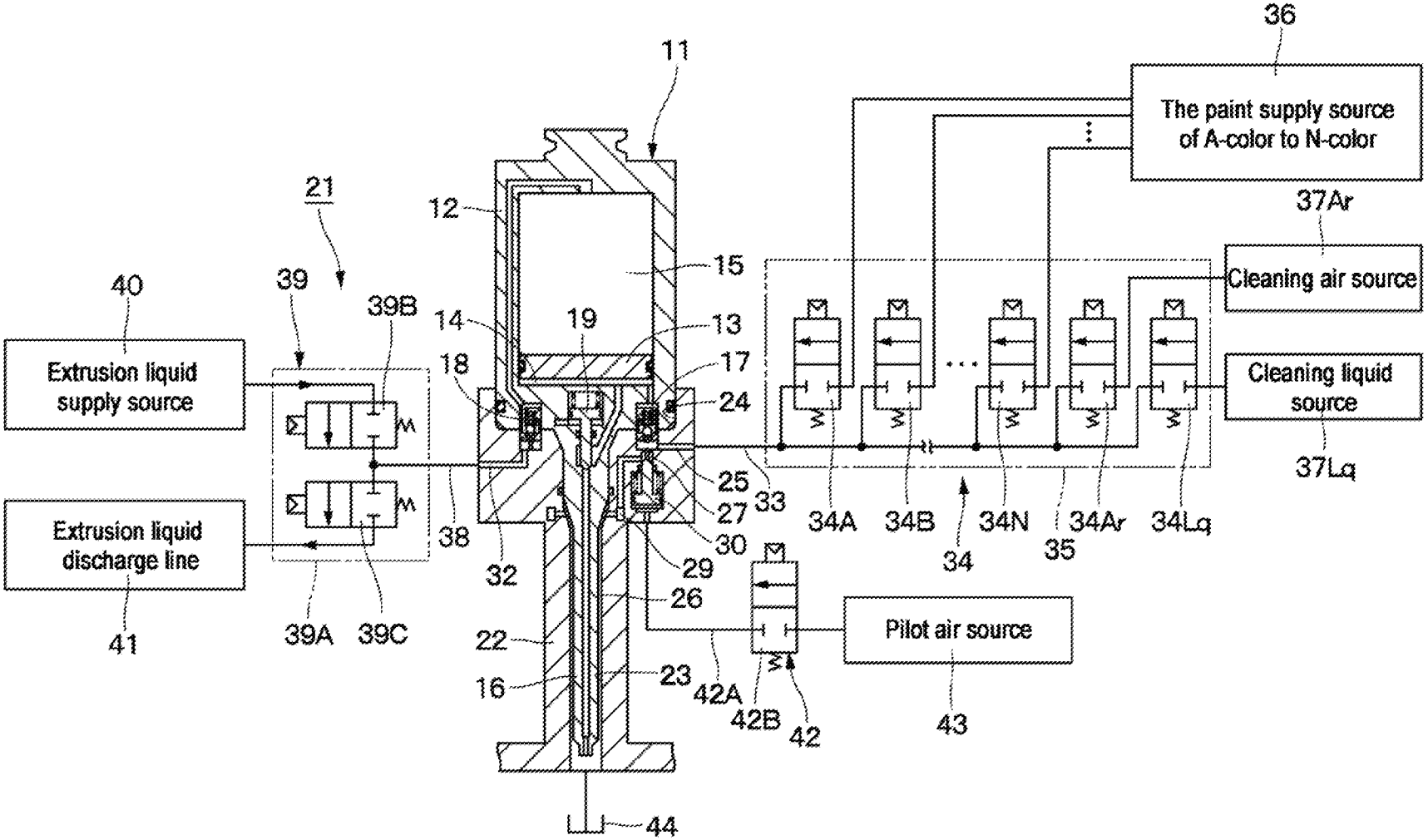
FIG. 4 is a diagram showing a circuit of the paint refilling device for a cartridge according to the first embodiment.

The paint refilling device for a cartridge 21 is provided nearby an operating range of the painting robot 102 (see FIG. 1). The paint refilling device for a cartridge 21 cleans the used cartridge 11 used for painting and refills the paint of the next color into the cartridge 11. Furthermore, as shown in FIG. 4, the paint refilling device for a cartridge 21 comprises the above-described cartridge 11, a cartridge supporting member 22, a circulation pipeline 25, an annular flow path 26, a feed tube cleaning pipeline 29, a pipeline switching valve 30, a sealing member 31 and a color change valve device 34 which will be described later.

Figure 5:
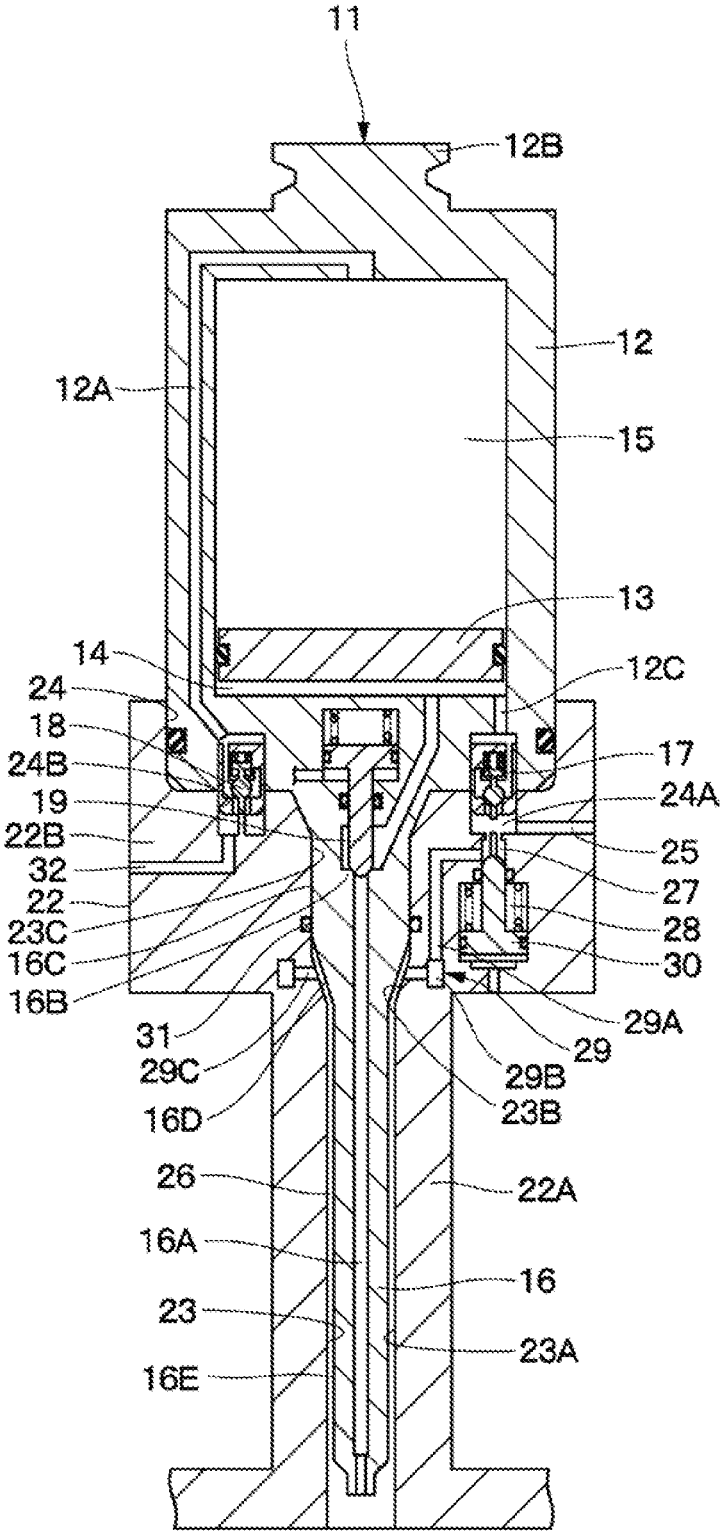
FIG. 5 is an enlarged longitudinal sectional view showing a cartridge, a cartridge supporting member, a feed tube cleaning pipeline and the like in FIG. 4.
Figure 6:
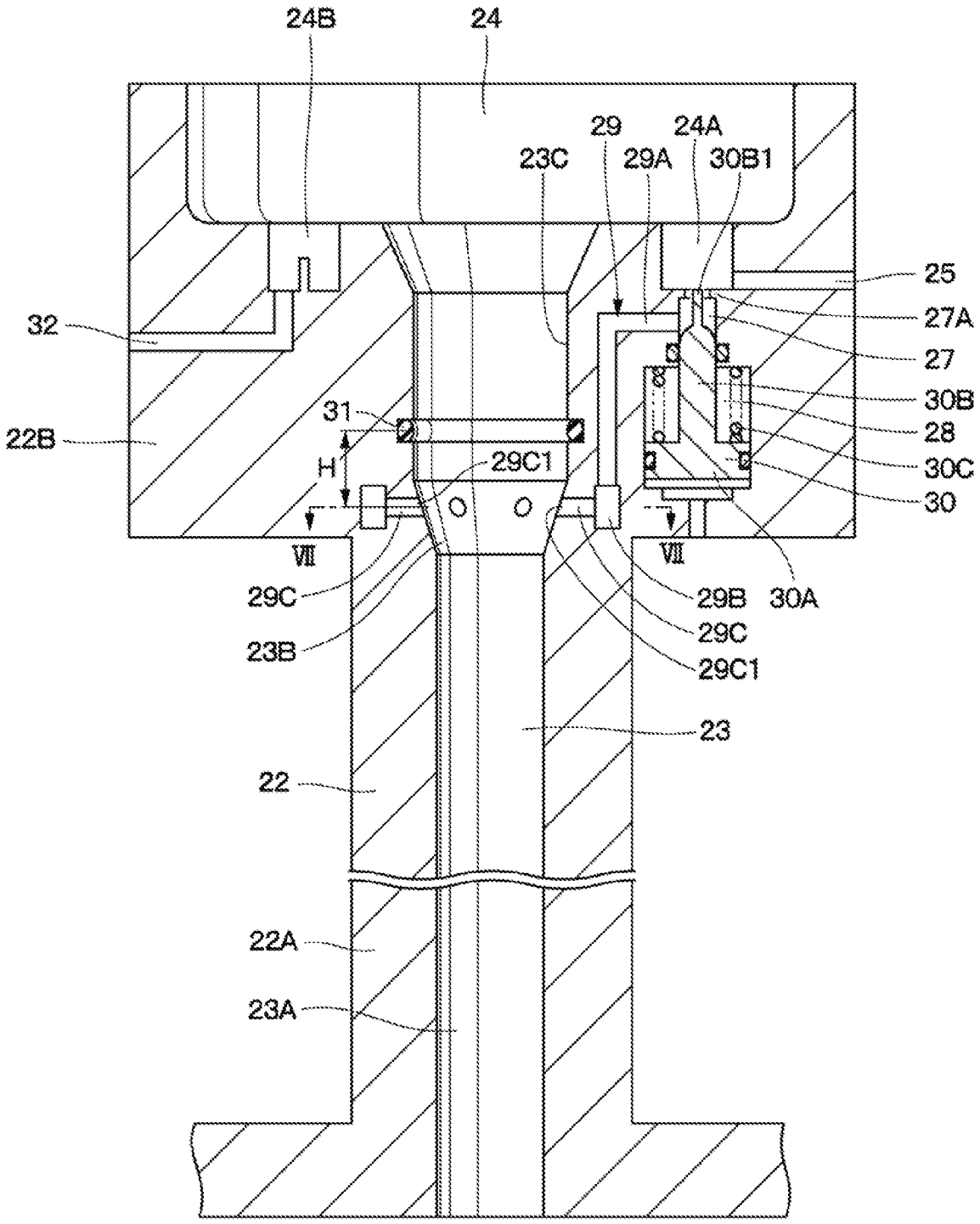
FIG. 6 is an enlarged longitudinal sectional view showing the cartridge supporting member and the feed tube cleaning pipeline and the like in FIG. 5.

The cartridge supporting member 22 constitutes a basic portion of the paint refilling device for a cartridge 21. An example of the shape of the cartridge supporting member 22 will be described. As shown in FIGS. 5 and 6, the cartridge supporting member 22 is formed as a stepped cylindrical shape with a leg column portion 22A composed of a small-diameter cylindrical body extending upward and downward and a base portion 22B making the upper side of the leg column portion 22A have an enlarged diameter.

The feed tube insertion hole 23 is disposed in such a manner that central portions of the leg column portion 22A and base portion 22B of the cartridge supporting member 22 extend in a vertical direction which becomes an axial direction. The feed tube insertion hole 23 allows the feed tube 16 of the cartridge 11 to be inserted therein. Furthermore, when the feed tube 16 is inserted into the feed tube insertion hole 23, the annular flow path 26 to be described later is formed between the feed tube insertion hole 23 and the feed tube 16.

That is, the feed tube insertion hole 23 is formed as a long ruler-shaped stepped hole with a small-diameter hole portion 23A opposite to a small-diameter portion 16E of the feed tube 16 radially, an inclined hole portion 23B opposite to a diameter-reduced portion 16D radially, and a large-diameter hole portion 16C opposite to a large-diameter portion 16C radially. The inclined hole portion 23B is provided with cleaning fluid discharge ports 29C1 of the feed tube cleaning pipeline 29 which will be described later. In addition, the large-diameter hole portion 23C is provided with a sealing member 31 to be described later.

The tank supporting portion 24 is provided on an upper portion of the base portion 22B formed as a base end side of the insertion direction of the feed tube insertion hole 23. The tank supporting portion 24 supports (positions) the tank 12 of the cartridge 11. The tank supporting portion 24 is formed as a shallow circular recess. A valve connecting portion 24A connected with the paint chamber open/close valve 17 of the cartridge 11 and a valve connecting portion 24B connected with an extrusion liquid sealing valve 18 are formed at the bottom of the tank supporting portion 24 separately.

A circulation pipeline 25 and a feed tube cleaning pipeline 29 are connected to the valve connecting portion 24A. Further, an extrusion liquid pipeline 38 to be described later is connected to the valve connecting portion 24B.

The circulation pipeline 25 is provided on the cartridge supporting member 22 so as to be connected to the paint chamber 14 of the cartridge 11. The circulation pipeline 25 allows circulation of the paint and the cleaning fluid. An upstream side of the circulation pipeline 25 is connected with the paint pipeline 33 which will be described later, and a downstream side of the circulation pipeline 25 is connected to the bottom side of the valve connecting portion 24A of the tank supporting portion 24.

The annular flow path 26 is formed between the feed tube 16 and the feed tube insertion hole 23 when the feed tube 16 of the cartridge 11 is inserted into the feed tube insertion hole 23 of the cartridge supporting member 22. The annular flow path 26 is formed as an annular (cylindrical) space extending from the base end side of the feed tube 16 in insertion direction towards a front end side. The annular flow path 26 enables circulation of the cleaning fluid (air, or liquid such as a diluent) for cleaning the outer circumferential surface of the inserted feed tube 16.

An end of a switching flow path 27 in the lengthwise direction is in communication with a bottom surface of the valve connecting portion 24A of the tank supporting portion 24. On the other hand, the other end of the switching flow path 27 in the lengthwise direction extends along a side opposite to the valve connecting portion 24A and is in communication with the valve chamber 28. In the switching flow path 27, a diameter of the valve connecting portion 24A at a boundary position is reduced to form a valve seat portion 27A. In addition, the feed tube cleaning pipeline 29 is connected at an intermediate position of the switching flow path 27 in the lengthwise direction.

Next, illustration will be presented for the configuration and function of the feed tube cleaning pipeline 29 which serves as a characterizing portion of the present embodiment.

The upstream side of the feed tube cleaning pipeline 29 is connected to the circulation pipeline 25 via the switching flow path 27 and the valve connecting portion 24A of the tank supporting portion 24. On the other hand, the downstream side of the feed tube cleaning pipeline 29 is provided at a base end side of the annular flow path 26. Specifically, the feed tube cleaning pipeline 29 comprises: a communication passageway 29A whose upstream side in the flowing direction of the cleaning fluid is connected with the switching flow path 27, and downstream side extends to a position nearby the inclined hole portion 23B of the feed tube insertion hole 23; an annular passageway 29B which is formed as an annular space surrounding the inclined hole portion 23B and connected to the communication passageway 29A; and a discharge passageway 29C which extends from the circular passageway 29B towards the inclined hole portion 23B and the inner diameter side.

Figure 7:
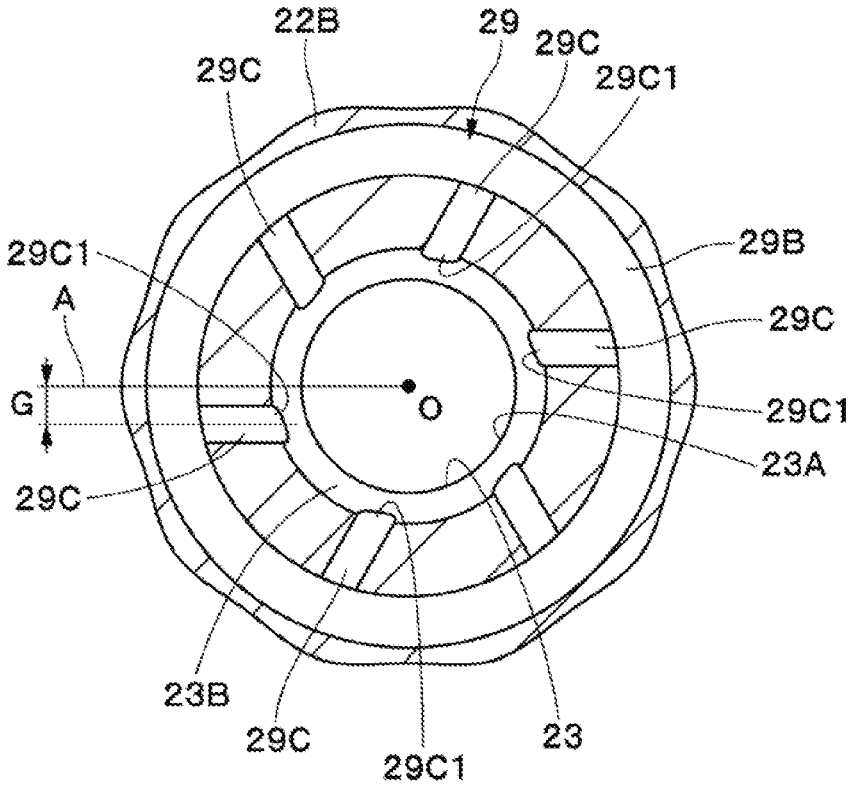
FIG. 7 is a cross-sectional view of the cartridge supporting member and the feed tube cleaning pipeline as viewed from the direction of arrows VII-VII in FIG. 6.

Here, the downstream side of the discharge passageway 29C of the feed tube cleaning pipeline 29 is formed as the cleaning fluid discharge portion 29C1, and is opened on the inclined hole portion 23B of the feed tube insertion hole 23 corresponding to the base end side of the annular flow path 26. In addition, as shown in FIG. 7, a plurality of discharge passageways 29C are spaced apart circumferentially by an interval in a manner of surrounding the annular flow path 26, for example, six discharge passageways 29C are spaced apart circumferentially by an interval of 60 degrees. The cleaning fluid discharge ports 29C1 of the six annular flow paths 29C are opened radially towards the annular flow path 26 on the inner diameter side.

In addition, the discharge passageways 29C (respective cleaning fluid discharge ports 29C1) of the feed tube cleaning pipeline 29 are respectively configured with a counterclockwise deviation dimension G relative to a straight line A radially extending through an axial center O of the feed tube insertion hole 23 as viewed from above. In the present embodiment, the deviation dimension G of the respective discharge passageways 29C is set to for example exceed 1 mm and less than 4 mm ($1 \leq G \leq 4$). In addition, the number and deviation dimension G of the discharge passageways 29C vary with the specification of the painting device.

Therefore, the respective discharge passageways 29C enable circulation of the cleaning fluid discharged from the cleaning fluid discharge ports 29C1 in the annular flow path 26 in a counterclockwise swirl flow manner. Thus, the cleaning fluid circulating in the swirl flow manner can efficiently clean the paint on the inner circumferential surface of the feed tube insertion hole 23 or the outer circumferential surface of the feed tube 16.

As shown in FIG. 6, a pipeline switching valve 30 is disposed in the valve chamber 28 of the cartridge supporting member 22. Upon supplying of the paint and cleaning fluid to the paint chamber 14 constituting the tank 12 of the cartridge 11, the pipeline switching valve 30 blocks communication between the circulation pipeline 25 and the feed tube cleaning pipeline 29, and upon supplying of the cleaning fluid to the annular flow path 26, the pipeline switching valve 30 enables communication between the circulation pipeline 25 and the feed tube cleaning pipeline 29.

The pipeline switching valve 30 is constituted as a bidirectional two-position constantly-open type air driven open/close valve, and it includes: a piston 30A disposed in the valve chamber 28 in an axially displaceable manner; a valve core 30B which extends from the piston 30A towards the switching flow path 27 and has a front end which is unseated/seated relative to the valve seat portion 27; and a valve spring 30C applying a force to the valve core 30B in a valve-opening direction by means of the piston 30A. On the other hand, a protrusion 30B1 is disposed at the front end of the valve core 30B, and when the valve core 30B is seated on the valve seat portion 27A, the protrusion 31B1 presses the valve core 17C of the paint chamber open/close valve 17 on the side of the cartridge 11 in the valve-opening direction.

Figure 10:
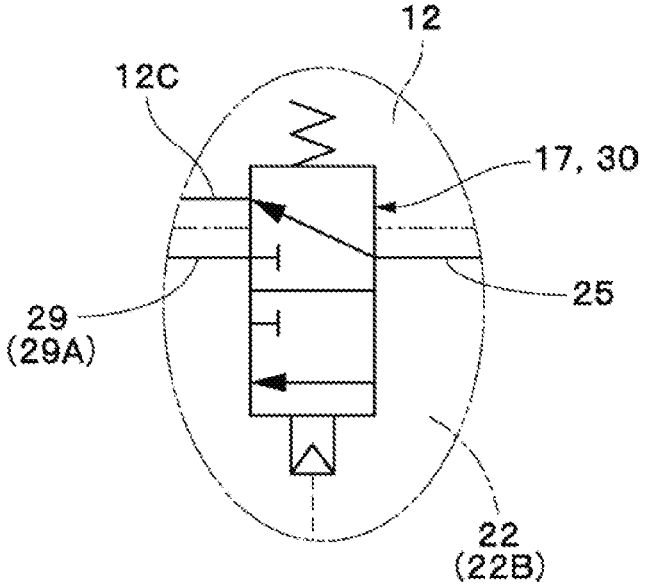
FIG. 10 is a diagram showing circuits of the paint chamber open/close valve and the pipeline switching valve with reference signs.
Figure 11:
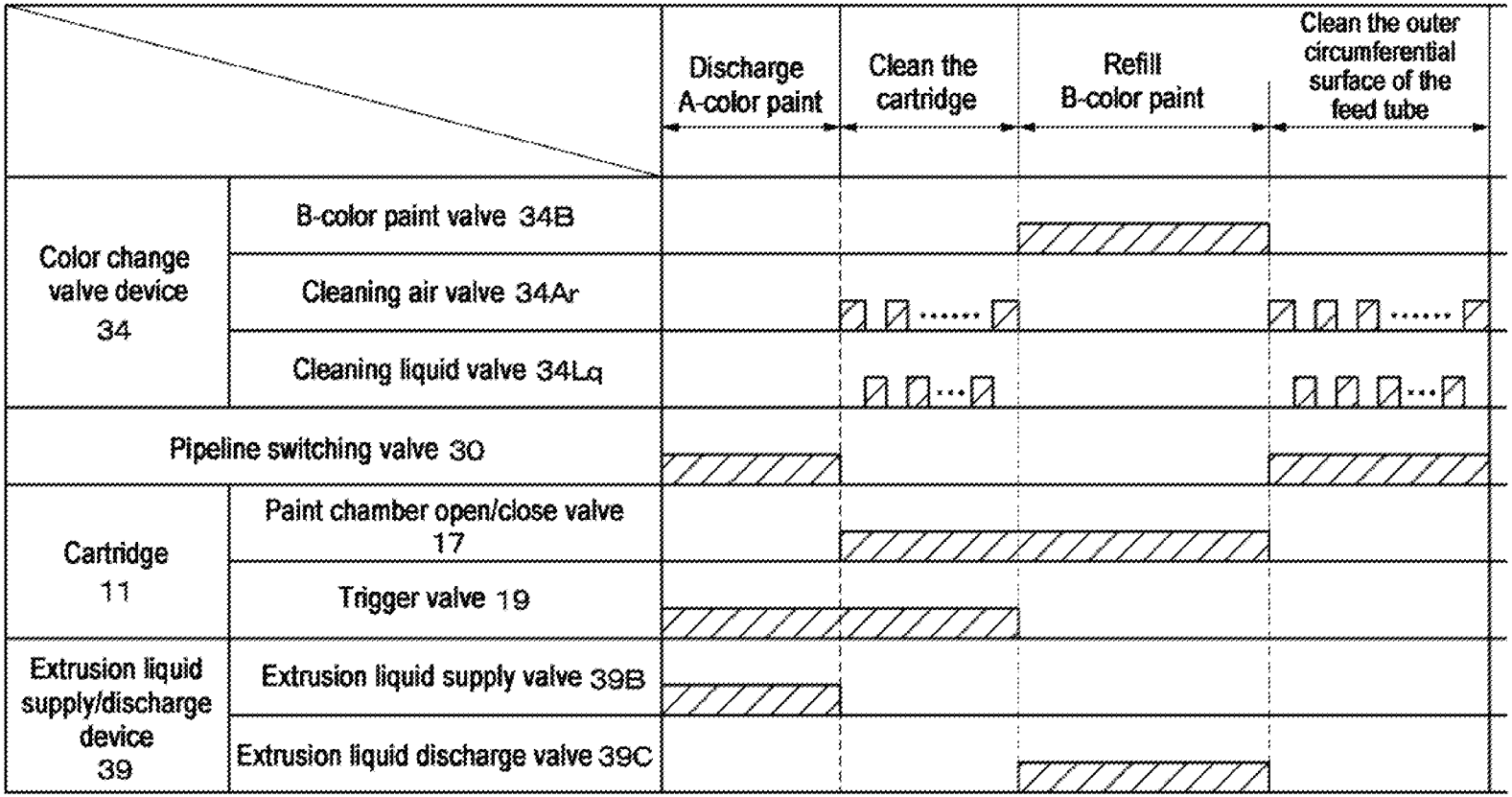
FIG. 11 is a timing chart of opening and closing operations of the cartridge and various valve cores provided in the paint refilling device for a cartridge.

In this way, when the paint and cleaning fluid are supplied to the paint chamber 14 of the cartridge 11, the pipeline switching valve 30 and the aforesaid paint chamber open/close valve 17 enables communication between the circulation pipeline 25 and the paint chamber 14 (paint flow path 12C), and blocks communication between the circulation pipeline 25 and the feed tube cleaning pipeline 29 (switching flow path 27). On the other hand, when the cleaning fluid is supplied to the annular flow path 26, the pipeline switching valve 30 and the aforesaid paint chamber open/close valve 17 block communication between the circulation pipeline 25 and the paint chamber 14 and enable communication between the circulation pipeline 25 and the feed tube cleaning pipeline 29. As stated above, the pipeline switching valve 30 and the paint chamber open/close valve 17 constitute a two-position three-way switching valve as shown in FIG. 10 by cooperating with each other and.

Furthermore, in addition to the configuration of the valve core 30B being provided with the protrusion 30B1, a protrusion may also be provided on the valve core 17C of the paint chamber open/close valve 17. In addition, it is also possible to provide protrusions on both of the valve core 30B of the pipeline switching valve 30 and the valve core 17C of the paint chamber open/close valve 17.

The sealing member 31 is disposed on the base portion 22B of the cartridge supporting member 22. The sealing member 31 is formed as an annular O ring for providing sealing between the feed tube insertion hole 23 and the feed tube 16. The sealing member 31 is configured at a position of the feed tube insertion hole 23 adjacent to the lower side of the large-diameter hole portion 23C. Specifically, the sealing member 31 is configured at the base end side of the feed tube insertion hole 23 relative to the discharge passageway 29C (cleaning fluid discharge port 29C1) of the feed tube cleaning pipeline 29. In this case, the sealing member 31 is configured within a range of the dimension H away from the discharge passageway 29C (cleaning fluid discharge port 29C1) so that the cleaning fluid reaches the sealing member 31 and can clean the paint. As a specific dimension, the dimension H is 15 mm at most. In addition, the dimension H varies with the specification of the painting device).

The upstream side of the extrusion liquid flow path 32 is connected to the extrusion liquid pipeline 38 which will be described later, and the downstream side is connected to the bottom side of the valve connecting portion 24B of the tank supporting portion 24. The extrusion liquid flow path 32 enables communication of the extrusion liquid between the extrusion liquid chamber 15 of the cartridge 11 and an extrusion liquid supply-discharge device 39.

As shown in FIG. 4, the paint pipeline 33 is disposed in a manner of being connected to the base portion 22B of the cartridge supporting member 22. One end side of the paint pipeline 33 as the upstream side is communicated with the discharge ports of the color change valve device 34 for discharging the paint and the cleaning fluid, and the other end is connected with the circulation pipeline 25 of the tank supporting portion 24.

The color change valve device 34 constitutes the paint supply device, which is connected to the circulation pipeline 25 of the cartridge supporting member 22 via the paint pipeline 33. The color change valve device 34 selects, from paints of multiple colors, a paint to be refilled to the cartridge 11 upon paint refilling, and supplies the selected paint to the paint chamber 14 of the cartridge 11 via the paint pipeline 33. In addition, when the residual paints in the paint chamber 14 and the paint supply passageway 16A of the feed tube 16 are cleaned, the color change valve device 34 supplies the cleaning liquid and cleaning air serving as cleaning fluid to the paint chamber 14 and paint supply passageway 16A.

The color change valve device 34 is a device selectively supplying the control paint and the cleaning fluid to the cartridge 11. The color change valve device 34 is connected to paint valves 34A, 34B, . . . 34N of color A, color B, . . . color N, a cleaning air valve 34Ar and a cleaning liquid valve 34Lq built within the valve casing 35. The paint valves 34A, 34B, . . . 34N of color A, color B, . . . color N are respectively connected with a paint supply source 36 supplying paints of color A, color B, . . . color N, and connected to the paint pipeline 33. Upon refilling of the paint to the cartridge 11, the paint valves 34A, 34B, . . . 34N are opened, and supply the paints of color A, color B, . . . color N from the paint supply source 36.

In addition, the cleaning air valve 34Ar is connected to the cleaning air source 37Ar and the paint pipeline 33, and the cleaning liquid valve 34Lq is connected to the cleaning liquid source 37Lq and the paint pipeline 33. The cleaning air valve 34Ar and the cleaning liquid valve 34Lq are alternately opened and closed when cleaning the cartridge 11 to supply cleaning air and cleaning liquid.

On the other hand, as shown in FIG. 9, when the pipeline switching valve 30 is opened, the color change valve device 34 supplies the cleaning air and the cleaning liquid to the annular flow path 26 through the switching flow path 27 and the feed tube cleaning pipeline 29.

Here, the valves 34A, 34B, . . . 34N, 34Ar, 34Lq employ a bidirectional, two-position air-driven open/close valve that is normally closed and is opened by supplying pressurized air.

The extrusion liquid pipeline 38 is connected to the base portion 22B of the cartridge supporting member 22. One end side of the extrusion liquid pipeline 38 is connected to an extrusion liquid supply/discharge device 39 described later, and the other end side is connected to the extrusion liquid flow path 32 of the tank supporting portion 24.

The extrusion liquid supply/discharge device 39 is connected to the cartridge supporting member 22 via the extrusion liquid pipeline 38. The extrusion liquid supply/discharge device 39 supplies the extrusion liquid from the extrusion liquid supply source 40 to the extrusion liquid chamber 15 of the cartridge 11 when cleaning the paint of the previous color used in the previous painting operation. On the other hand, when the paint is refilled to the paint chamber 14, the extrusion liquid is discharged from the extrusion liquid chamber 15 to an extrusion liquid discharge line 41.

The extrusion liquid supply/discharge device 39 is a device for supplying and discharging the extrusion liquid to and from the extrusion liquid chamber 15 of the cartridge 11. The extrusion liquid supply/discharge device 39 is roughly constituted of an extrusion liquid supply valve 39B and an extrusion liquid discharge valve 39C built in a valve casing 39A. The extrusion liquid supply valve 39B is connected to the extrusion liquid supply source 40 and is connected to the extrusion liquid pipeline 38. The extrusion liquid supply valve 39B supplies the extrusion liquid from the extrusion liquid supply source 40 to the extrusion liquid chamber 15.

On the other hand, the extrusion liquid discharge valve 39C is connected to the extrusion liquid discharge line 41 and also connected to the extrusion liquid pipeline 38. The extrusion liquid discharge valve 39C is opened when the paint is refilled to the paint chamber 14, causing the extrusion liquid in the extrusion liquid chamber 15 to flow out to the extrusion liquid discharge line 41. Here, the extrusion liquid supply valve 39B and the extrusion liquid discharge valve 39C employ a bidirectional, two-position air-driven open/close valve that is normally closed and is opened by supplying pressurized air.

The switching valve open/close device 42 opens and closes the pipeline switching valve 30. The switching valve open/close device 42 is constructed as including a pilot air pipeline 42A that connects the pipeline switching valve 30 with a pilot air source 43, and a pilot air valve 42B composed of a bidirectional, two-position air-driven open/close valve provided in the pilot air pipeline 42A.

A waste liquid tank 44 receives and stores waste liquid such as the paint discharged from the tank 12 of the cartridge 11 and the cleaning liquid for cleaning the inside and the outside of the cartridge 11.

The paint refilling device for a cartridge 21 according to the first embodiment has the above-described configuration. Next, a color changing method for moving the used cartridge 11 to the cartridge paint refilling device 21 refilling the cartridge 11 with the paint will be described. In addition, in the color changing method, a case of changing the color from the A color paint as the previous color paint used in the previous painting operation to the B color paint as the next color paint used in the next painting operation will be described as an example.

In addition, at this time, the A color paint used in the previous painting operation remains in the paint chamber 14 of the cartridge 11 and the paint supply passageway 16A of the feed tube 16 respectively. Further, A color paint is adhered to the outer circumferential surface of the feed tube 16.

First, when the painting operation of the rotary atomizing head type painting device 1 using the A color paint is finished, the painting machine 4 on which the used cartridge 11 is mounted is conveyed to the cartridge paint refilling device 21 by the painting robot 102. When the painting machine 4 and the cartridge 11 are disposed at the attachment/detachment position of the cartridge 11, the cartridge transporting device 105 grips a gripping protrusion 12B provided on the tank 12 of the cartridge 11, and pulls the cartridge 11 upwardly out of the painting machine 4 (the cartridge mounting portion 2B of the housing 2). In addition, the cartridge transporting device 105 transports the used cartridge 11 that has been pulled out to the paint refilling device for a cartridge 21.

Next, a refilling method for refilling paint into the cartridge 11 with the paint refilling device for a cartridge 21 will be described. In this case, referring to the timing chart shown in FIG. 11, the switching state of the open/close valves of various valve cores provided in the cartridge 11 and the cartridge paint refilling device 21 will be described in detail.

The cartridge transporting device 105 transports the used cartridge 11 to the paint refilling device for a cartridge 21 lowers the cartridge 11 from the upper side toward the cartridge supporting member 22 and inserts the feed tube 16 into the feed tube insertion hole 23, and mounts the tank 12 to the tank supporting portion 24. Thus, the used cartridge 11 is assembled on the cartridge supporting member 22 (see FIG. 5).

At this time, the annular flow path 26 is formed between the feed tube insertion hole 23 of the cartridge supporting member 22 and the feed tube 16 of the cartridge 11 so as to extend upward and downward. The cleaning fluid circulates in the annular flow path 26 in a feed tube cleaning process which will be described later.

When the used cartridge 11 is assembled to the cartridge supporting member 22, as shown in FIG. 9, the paint chamber open/close valve 17 on the side of the cartridge 11 is fitted into the valve connecting portion 24A of the tank supporting portion 24 constituting the cartridge supporting member 22, and an extrusion liquid sealing valve 18 is fitted to the valve connecting portion 24B of the tank supporting portion 24. At this time, the paint chamber open/close valve 17 is kept closed as a check valve. On the other hand, the extrusion liquid sealing valve 18 is pressed by the valve connecting portion 24B to be opened so that the extrusion liquid chamber 15 is communicated with the extrusion liquid pipeline 38 via the extrusion liquid flow paths 32, 12A.

Next, the process proceeds to the A color paint discharging process for discharging the residual A color paint from the cartridge 11. In the A color paint discharging process, a trigger valve 19 of the cartridge 11 is opened, and the extrusion liquid supply valve 39B of the extrusion liquid supply/discharge device 39 is opened, so that the extrusion liquid supply source 40 is communicated with the extrusion liquid chamber 15. Thereby, the extrusion liquid from the extrusion liquid supply source 40 can be supplied to the extrusion liquid chamber 15 via the extrusion liquid pipeline 38, the extrusion liquid flow path 32, the extrusion liquid sealing valve 18, and the extrusion liquid flow path 12A.

As a result, the piston 13 of the cartridge 11 is pushed to a minimum side of the paint chamber 14. In this way, the residual A color paint in the paint chamber 14 is discharged to the waste liquid tank 44 through the paint supply passageway 16A of the feed tube 16, and the operation relating to the A color paint discharging process is completed.

Next, when the A color paint discharging process is completed, the process proceeds to a cartridge cleaning process for washing out the A color paint remaining in the paint chamber 14 of the cartridge 11 and the paint supply passageway 16A of the feed tube 16.

In the cartridge cleaning step, first, the extrusion liquid supply valve 39B of the extrusion liquid supply/discharge device 39 is closed. Thereby, the volume of the paint chamber 14 is kept in a minimum state. At this time, the trigger valve 19 is in the open state similar to the case in the A color paint discharging process.

Furthermore, as shown in FIG. 8, the valve core 30B of the pipeline switching valve 30 is displaced toward the paint chamber open/close valve 17, and the front end of the valve core 30B is seated on the valve seat portion 27A of the switching flow path 27. Thereby, the pipeline switching valve 30 blocks communication between the valve connecting portion 24A (circulation pipeline 25) and the switching flow path 27 (feed tube cleaning pipeline 29). Further, when the valve core 30B of the pipeline switching valve 30 is displaced toward the paint chamber open/close valve 17, the valve core 30B pushes the valve core 17C of the paint chamber open/close valve 17 in the valve opening direction. Thereby, since the pipeline switching valve 30 and the paint chamber open/close valve 17 function as a two-position three-way switching valve (see FIG. 10), the color change valve device 34 and the paint chamber 14 can be connected.

When the color change valve device 34 is connected to the paint chamber 14, the cleaning air valve 34Ar and the cleaning liquid valve 34Lq of the color change valve device 34 are alternately opened and closed repeatedly, so that the cleaning air in the cleaning air source 37Ar and the cleaning liquid in the cleaning liquid source 37Lq are alternatingly circulated to the paint chamber 14 and the paint supply passageway 16A of the feed tube 16 via the paint pipeline 33. As a result, the A-color paint remaining in the paint chamber 14 and the paint supply passageway 16A is washed away by the cleaning air and cleaning liquid and discharged to the waste liquid tank 44, and the operation relating to the cartridge cleaning process is completed.

Next, when the cartridge cleaning process is completed, the process proceeds to a paint refilling process for refilling the paint chamber 14 with the B color paint. In this B-color paint refilling process, the trigger valve 19 is made in a closed state. At this time, the B-color paint valve 34B of the color change valve device 34 and the extrusion liquid discharge valve 39C of the extrusion liquid supply/discharge device 39 are opened. As a result, the B-color paint stored in the paint supply source 36 is refilled into the paint chamber 14 through the paint pipeline 33, the paint chamber open/close valve 17 of the cartridge 11, and the paint flow path 12C. At this time, the same amount of the extrusion liquid equal to the paint refilled in the paint chamber 14 is discharged from the extrusion liquid chamber 15 toward the extrusion liquid discharge line 41 through the extrusion liquid discharge valve 39C.

Next, when the process of refilling the paint chamber 14 with the B-color paint is completed, the process proceeds to a cleaning process of cleaning the outer circumferential surface of the feed tube for cleaning the paint adhering to the outer circumferential surface of the feed tube 16 of the cartridge 11. In this process of cleaning outer circumferential surface of the feed tube, the valve core 30B of the pipeline switching valve 30 is separated from the valve seat portion 27A of the switching flow path 27 (opened), enabling communication between the valve connecting portion 24A (the circulation pipeline 25) and the switching flow path 27 (the feed tube cleaning pipeline 29). At this time, since the valve core 30B of the pipeline switching valve 30 is separated from the valve core 17C of the paint chamber open/close valve 17, the paint chamber open/close valve 17 is closed. As a result, the pipeline switching valve 30 and the paint chamber open/close valve 17 can allow the color change valve device 34 to be connected with the annular flow path 26.

When the color change valve device 34 is connected to the annular flow path 26, the cleaning air valve 34Ar and the cleaning liquid valve 34Lq of the color change valve device 34 are alternately opened and closed repeatedly, so that the cleaning air in the cleaning air source 37Ar and the cleaning liquid in the cleaning liquid source 37Lq are circulated to the annular flow path 26 through the paint pipeline 33, the circulation pipeline 25, the valve connecting portion 24A of the tank supporting portion 24, the switching flow path 27, and the feed tube cleaning pipeline 29. Thereby, the A-color paint adhering to the outer circumferential surface of the feed tube 16 is washed away by the cleaning air and the cleaning liquid circulating the annular flow path 26, and the feed tube cleaning process is completed.

Here, when the painting machine 4 and the cartridge 11 are arranged at the attachment/detachment position of the cartridge 11 by the painting robot 102, sometimes a slight error occurs between a stop position of the cartridge 11 and a gripping position where the cartridge 11 is gripped by the cartridge transporting device 105. In addition, in general, the painting machine 4 is reduced in size by reducing the gap between the inner circumferential surface of the rotary shaft 6 into which the feed tube 16 of the cartridge 11 is inserted and the outer circumferential surface of the feed tube 16.

As described above, when an error occurs in the stop position of the cartridge 11, the outer circumferential surface of the feed tube 16 would contact the inner circumferential surface of the rotary shaft 6 which constitutes a portion of the insertion hole 3 when the cartridge 11 is pulled out from the painting machine 4 (housing 2) with the cartridge transporting device 105. At this time, if the paint adheres to the front end side of the feed tube 16, the paint would adhere to the inner circumferential surface of the rotary shaft 6. Therefore, when the operation of pulling the cartridge 11 out of the painting machine 4 is repeated, the paint adheres and extends to the entirety of the insertion hole 3 including the inner circumferential surface of the rotary shaft 6 and the outer circumferential surface of the feed tube 16. On the other hand, the paint extending to the inner circumferential surface of the rotary shaft 6 may reach the air bearing 5C or the air turbine 5B of the air motor 5 sometimes.

Furthermore, the paint accumulates on the rotary shaft 6 and the feed tube 16 and so on over time, and the accumulated paint peels off and becomes paint residue shortly thereafter. The position where the paint residue is generated is between the rotary shaft 6 (insertion hole 3) and the feed tube 16, that is, the annular flow path 26. This annular channel 26 is connected with the rotary atomizing head 7 which sprays the paint. If the paint residue enters the rotary atomizing head 7, there is a concern that it may be sprayed toward the object together with the paint. In addition, in a case where the paint extending on the rotary shaft 6 adheres to the air bearing 5C or the air turbine 5B of the air motor 5, defects such as poor rotation might occur.

However, according to the first embodiment, an annular flow path 26, extending from the base end side to the front end side in the insertion direction, is provided between the feed tube 16 of the cartridge 11 and the feed tube insertion hole 23 of the cartridge supporting member 22. On the basis, the cartridge supporting member 22 is provided with: the feed tube cleaning pipeline 29 whose upstream side is connected to the circulation pipeline 25 disposed in the cartridge supporting member 22, and whose downstream side serves as a cleaning fluid discharge port 29C1, and is opened at the base end side of the annular flow path 26; and a pipeline switching valve 30 which blocks communications between the circulation pipeline 25 and the feed tube cleaning pipeline 29 when the paint and cleaning fluid is supplied to the paint chamber 14 of the cartridge 11, and enables communications between the circulation pipeline 25 and the feed tube cleaning pipeline 29 when the cleaning fluid is supplied to the annular flow path 26.

Therefore, in the paint refilling device for a cartridge 21, each time when the paint is refilled in the cartridge 11, the A-color paint adhering to the outer circumferential surface of the feed tube 16 is cleaned by the cleaning fluid, consisting of the cleaning air and the cleaning liquid, circulated in the annular flow path 26.

As a result, when the cartridge 11 is mounted to the painting machine 4, it is possible to suppress the paint from adhering to the inner circumferential surface of the insertion hole 3 (rotary shaft 6). As a result, it is possible to prevent deterioration of the painting quality caused by the blending of the paint residual into the sprayed paint and poor rotation of the air motor 5 caused by adhesion of the paint. In addition, it is possible to prevent a reduction in the rotational speed detection function caused by the adhesion of the paint to the optical fibers of the air motor 5. Furthermore, it is possible to prevent drop of the paint during movement of the cartridge 11, and keep the device clean.

The respective discharge passageways 29C constituting the feed tube cleaning pipeline 29 allow the cleaning fluid discharge ports 29C1 to be opened radially towards the annular flow path 26, and a plurality of discharge passageways 29C, for example six discharge passageways 29C, are spaced apart circumferentially by an interval in a way of surrounding the annular flow path 26. As such, it is possible to enable the cleaning fluid to be circulated within a full-circumference range of the annular flow path 26 without any omission, and to efficiently clean the entirety of the outer circumferential surface of the feed tube 16.

Moreover, the cleaning fluid discharge ports 29C1 of the discharge passageways 29C constituting the feed tube cleaning pipeline 29 are configured with a counterclockwise deviation dimension G relative to a straight line A radially extending through an axial center O of the feed tube insertion hole 23 as viewed from top. The respective discharge passageways 29C enable the cleaning fluid discharged from the cleaning fluid discharge ports 29C1 to be circulated in the annular flow path 26 in a counterclockwise swirl flow manner. Thus, the cleaning fluid becoming the swirl flow can efficiently, namely, with a small amount of fluid and short period of time, clean the paint adhering on the inner circumferential surface of the feed tube insertion hole 23 or the outer circumferential surface of the feed tube 16.

The cartridge supporting member 22 is provided with an annular sealing member 31, and the annular sealing member 31 is located closer to the base end side of the feed tube insertion hole 23 than the cleaning fluid discharge ports 29C1 of the discharge passageways 29C constituting the feed tube cleaning pipeline 29, and the annular sealing member 31 provides sealing between the feed tube insertion hole 23 and the feed tube 16. Therefore, even when the cleaning fluid mixed with the paint flows upward through the annular flow path 26 during the cleaning operation of the feed tube 16, the sealing member 31 can limit it within an extent where the sealing member 31 can be cleaned by the cleaning fluid discharged from the respective cleaning fluid discharge ports 29C1. Hence, it is also possible to reliably clean the portion of the feed tube 16 higher than the cleaning fluid discharge ports 29C1.

The cartridge 11 is provided with a paint chamber open/close valve 17 located between the paint chamber 14 and the circulation pipeline 25. The paint chamber open/close valve 17 can enable communication between the circulation pipeline 25 and the paint chamber 14 when supplying the paint and cleaning fluid to the paint chamber 14. On the other hand, the paint chamber open/close valve 17 can block communication between the circulation pipeline 25 and the paint chamber 14 when supplying the cleaning fluid to the annular flow path 26.

The pipeline switching valve 30 and the paint chamber open/close valve 17 are cooperated with each other and constitute a two-position three-way switching valve. Accordingly, upon supplying of the paint and the cleaning fluid to the paint chamber 14 of the cartridge 11, the pipeline switching valve 30 and the paint chamber open/close valve 17 enable communicate the circulation pipeline 25 with the paint chamber 14 and block communication between the circulation pipeline 25 and the feed tube cleaning pipeline 29. On the other hand, upon supplying of the cleaning fluid to the annular flow path 26, the pipeline switching valve 30 and the paint chamber open/close valve 17 block communication between the circulation pipeline 25 and the paint chamber 14, and enable communication between the circulation pipeline 25 and the feed tube cleaning pipeline 29. As a result, the paint chamber open/close valve 17 can be operated by driving the pipeline switching valve 30 only, and the control and configuration can be simplified. On this basis, it is possible to, upon performing the cleaning operation for the feed tube 16, supply the cleaning fluid between the pipeline switching valve 30 and the paint chamber open/close valve 17 to clean the paint chamber open/close valve 17.

Figure 12:
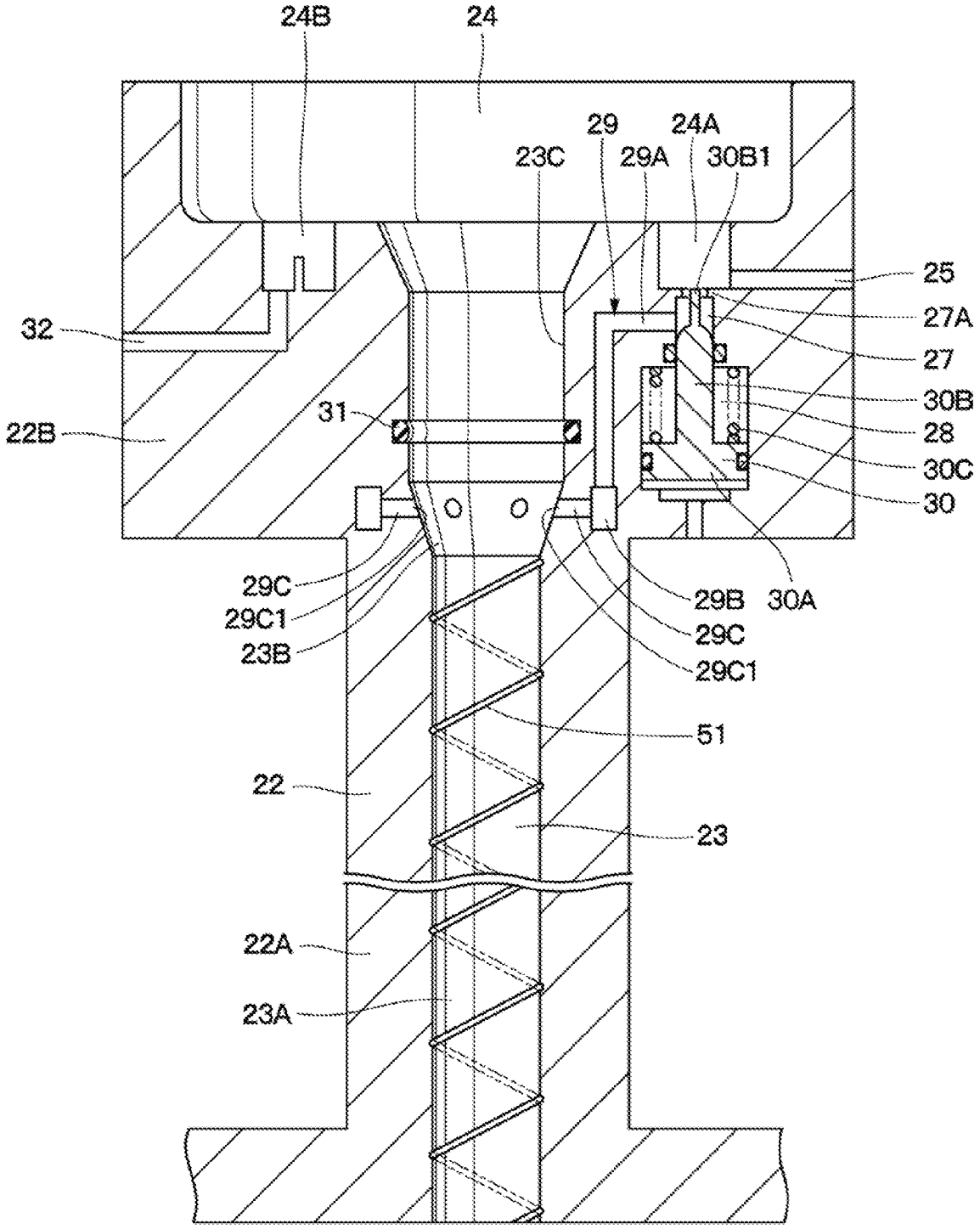
FIG. 12 is a longitudinal sectional view of the feed tube cleaning pipeline and the cartridge supporting member according to a second embodiment as simultaneously viewed from the same position as in FIG. 6.

Next, FIG. 12 shows a second embodiment of the present disclosure. The second embodiment is characterized in that at least one of the inner circumferential surface of the feed tube insertion hole and the outer circumferential surface of the feed tube is provided with a swirl flow forming member for using the annular flow path to allow the cleaning fluid to circulate in a spiral form. In addition, in the second embodiment, the same components as those in the first embodiment are denoted by the same reference signs, and the description thereof is omitted.

In FIG. 12, the swirl flow forming member 51 according to the second embodiment is provided on the inner circumferential surface of the feed tube insertion hole 23 of the cartridge supporting member 22. The swirl flow forming member 51 enables the cleaning fluid to circulate spirally by using the annular flow path 26. Specifically, the swirl flow forming member 51 is formed as a spiral concave groove over the entire length of the small-diameter hole portion 23A of the feed tube insertion hole 23. In addition, the swirl flow forming member 51 may be formed as a spiral protruding strip.

Thus, according to the second embodiment configured as described above, the swirl flow forming member 51 can enable the cleaning fluid to be circulated spirally when the cleaning fluid is circulated in the annular flow path 26. Thereby, the outer circumferential surface of the feed tube 16 can be cleaned with the cleaning fluid composed of the swirl flow.

In addition, in the first embodiment, illustration is presented by taking an example where the paint supply device uses the color change valve device 34, wherein the color change valve device 34 supplies a paint selected from paints of multiple colors (A-color to N-color) to the paint chamber 14 of the cartridge 11, and the color change valve device 34 supplies the cleaning fluid to the paint chamber 14 and the paint supply passageway 16A in the feed tube 16 when the residual paint in the paint chamber 14 is cleaned. However, the present disclosure is not limited to this. For example, the following paint supply device may also be applied to: supply a paint of a dedicated color to the paint chamber 14 of the cartridge 11, and supply the cleaning fluid to the paint chamber 14 and the paint supply passageway 16A in the feed tube 16 when the residual paint in the paint chamber 14 is cleaned. This configuration can be similarly applied to the second embodiment.

In addition, the first embodiment exemplarily illustrates a case in which the tank 12 of the cartridge 11 is exemplarily formed as a cylindrical tank with both ends thereof closed in the axial direction, and the circular piston 13 forming the partition is axially displaceable inserted in the tank 12. However, the present disclosure is not limited to this configuration, and as described above, for the configuration of supplying a paint of a dedicated color to the paint chamber, it is also possible to use a bag-shaped cartridge provided in the tank and served as a bag-shaped thin film forming the partition. This configuration can be similarly applied to the second embodiment In the second embodiment, the case where the swirl flow forming member 51 is provided on the inner circumferential surface of the feed tube insertion hole 23 of the cartridge supporting member 22 has been described as an example. However, the present disclosure is not limited to this, and the swirl flow forming member may be provided on the outer circumferential surface of the feed tube 16. In addition, it may also be configured that the swirl flow forming member is provided on both the inner circumferential surface of the feed tube insertion hole of the cartridge supporting member and the outer circumferential surface of the feed tube.

In each embodiment, the painting machine on which the cartridge 11 is mounted is illustrated by taking the rotary atomizing type painting device 1 having a rotary atomizing head 7 as example. However, the present disclosure is not limited to this. For example, it is also possible to mount the cartridge on the painting machine having an air atomizing nozzle, a hydraulic atomizing nozzle and so on.

We claim:

1. A paint refilling device for a cartridge, comprising:

a cartridge configured as comprising a tank for storing paint, a partition and a feed tube, the partition being movably disposed within the tank and dividing an interior of the tank into a paint chamber into which the paint is refilled and an extrusion liquid chamber for supplying or discharging extrusion liquid, a base end side of the feed tube being mounted to the tank and a front end side extending axially from the tank;

a cartridge supporting member provided with a feed tube insertion hole extending axially and allowing the feed tube to be inserted therethrough, and a tank supporting portion for supporting the tank of the cartridge at a base end side in an insertion direction of the feed tube insertion hole;

a circulation pipeline disposed on the cartridge supporting member in a manner of being connected to the paint chamber of the cartridge to circulate the paint and a cleaning fluid; and a paint supply device disposed to be connected to the circulation pipeline, to supply the paint to the paint chamber of the cartridge upon refilling of the paint, and to supply the cleaning fluid to the paint chamber and a supply passageway of the paint within the feed tube upon cleaning of the residual paint, wherein an annular flow path, extending from a base end side towards a front end side in the insertion direction, is disposed between the feed tube of the cartridge and the feed tube insertion hole of the cartridge supporting member, wherein the cartridge supporting member is provided with a feed tube cleaning pipeline and a pipeline switching valve, wherein an upstream side of the feed tube cleaning pipeline is connected with the circulation pipeline, and a downstream side is formed as cleaning fluid discharge ports which are opened at the base end side of the annular flow path, wherein the pipeline switching valve blocks communication between the circulation pipeline and the feed tube cleaning pipeline when the paint and the cleaning fluid are supplied to the paint chamber of the cartridge, and enables communication between the circulation pipeline and the feed tube cleaning pipeline when the cleaning fluid is supplied to the annular flow path.

2. The cartridge paint refilling device according to claim 1, wherein a swirl flow forming member for circulating the cleaning fluid spirally in the annular flow path is provided on at least one of an inner circumferential surface of the feed tube insertion hole and an outer circumferential surface of the feed tube.

3. The cartridge paint refilling device according to claim 1, wherein the cartridge supporting member is provided with an annular sealing member, and the annular sealing member is located closer to the base end side of the feed tube insertion hole as compared with the cleaning fluid discharge ports of the feed tube cleaning pipeline, and the annular sealing member provides sealing between the feed tube insertion hole and the feed tube.

4. The cartridge paint refilling device according to claim 1, wherein the cleaning fluid discharge ports of the feed tube cleaning pipeline are opened radially towards the annular flow path, and a plurality of cleaning fluid discharge ports are disposed to be circumferentially spaced apart by an interval in a manner of surrounding the annular flow path.

5. The cartridge paint refilling device according to claim 4, wherein the cleaning fluid discharge ports of the feed tube cleaning pipeline are configured in a state of deviating relative to straight lines radially extending through an axial center of the feed tube insertion hole.

6. The cartridge paint refilling device according to claim 1, wherein the cartridge is provided with a paint chamber open/close valve located between the paint chamber and the circulation pipeline, the paint chamber open/close valve enables communication between the circulation pipeline and the paint chamber when the paint and cleaning fluid are supplied to the paint chamber, and blocks communication between the circulation pipeline and the paint chamber when the cleaning fluid is supplied to the annular flow path.

7. The cartridge paint refilling device according to claim 6, wherein the pipeline switching valve and the paint chamber open/close valve constitute a two-position three-way switching valve by mutual cooperation, which enables communication between the circulation pipeline and the paint chamber and blocks communication between the circulation pipeline and the feed tube cleaning pipeline when the paint and the cleaning fluid are supplied to the paint chamber of the cartridge, and blocks communication between the circulation pipeline and the paint chamber, and enables communication between the circulation pipeline and the feed tube cleaning pipeline when the cleaning fluid is supplied the annular flow path.

* * * * *